US006820848B1

(12) United States Patent
Adam

(10) Patent No.: US 6,820,848 B1
(45) Date of Patent: Nov. 23, 2004

(54) PAINT CAN NO-DRIP CLIP APPARATUS

(76) Inventor: George E. Adam, 2214 Pebble Beach, League City, TX (US) 77573

( * ) Notice: Subject to any disclaimer, the term of this patent is extended or adjusted under 35 U.S.C. 154(b) by 0 days.

(21) Appl. No.: 10/463,358

(22) Filed: Jun. 17, 2003

(51) Int. Cl.[7] ..... F21V 35/00; A46B 17/02; B65D 25/00

(52) U.S. Cl. ..... 248/213.2; 248/110; 220/697; 220/700

(58) Field of Search ..... 248/213.2, 110, 248/221.11, 222.11, 222.12, 302; 220/700, 701, 697; 211/65

(56) References Cited

U.S. PATENT DOCUMENTS 124,928 A * 3/1872 Bailey ..... 220/697
1,176,009 A * 3/1916 Weimar ..... 211/65
1,972,861 A * 9/1934 Baillie ..... 220/701
1,994,335 A * 3/1935 Churan ..... 220/701
2,039,497 A * 5/1936 Simons ..... 211/65
2,196,614 A * 4/1940 Spitz ..... 220/697
2,284,452 A * 5/1942 Simons ..... 211/65
2,321,492 A * 6/1943 Kinney ..... 220/701
2,342,454 A * 2/1944 Coyliondro ..... 220/702
2,355,549 A * 8/1944 Myers ..... 200/700
2,452,025 A * 10/1948 Dunn ..... 248/110
2,466,850 A * 4/1949 Hoffman et al. ..... 220/697
RE23,911 E * 12/1954 Tatter ..... 220/701
2,815,146 A * 12/1957 Silver ..... 220/698
2,823,399 A * 2/1958 Stewart ..... 248/213.2
3,061,140 A * 10/1962 Barnes ..... 220/700
5,626,319 A * 5/1997 Fusillo ..... 248/213.2

* cited by examiner

*Primary Examiner*—Anita M. King
(74) *Attorney, Agent, or Firm*—Harrison Law Office

(57) ABSTRACT

An apparatus for clearing excess paint from paint brush bristles and for draining this excess paint back into the paint can. The no-drip clip apparatus comprises a circular members for securely clipping embodiments to a paint can rim, and a contiguous straight flusher member that is suspended across the paint can's mouth. A painter uses a suitable no-drip clip apparatus for reducing dripping of excess paint from the paint brush bristles onto the paint brush handle, the paint can rim, and, ultimately, onto nearby surfaces and objects during painting operations.

3 Claims, 6 Drawing Sheets

PAINT CAN NO-DRIP CLIP APPARATUS

BACKGROUND OF THE INVENTION

This invention relates to paint cans, and more particularly relates to an apparatus for clearing a paint brush of excess paint and for supporting a paint brush upon a paint can without dripping residual paint onto the paint brush handle, the paint can rim, or onto the floor and the like.

As is well known by those skilled in the art, painting typically is an inherently messy operation. It is a common practice by painters, to engage in a three-stage procedure while painting. First, the painter dips a paint brush into a paint can to deposit an adequate quantity of paint on the paint brush bristles. Second, the painter removes excess paint from the bristles by dragging the bristles—on both sides of the brush—over an edge of the can. Third, the painter performs the painting operation with the usual concomitant paint waste and mess.

It will be readily appreciated that, if a painter fails to adequately remove excess paint from brush bristles prior to commencing painting, dripping of paint will occur. This time-tested procedure not only wastes paint, but also dirties nearby surfaces and objects, potentially causing health and safety hazards. For example, if a painter is painting an elevated surface, then using a brush containing excess paint will cause dripping of such excess paint either directly from the paint brush bristles or indirectly via the paint brush handle. Obviously, dripping paint under such circumstances is apt to jeopardize painters' health. Indeed, since there is typically a linear relationship between painters' hands and eyes and the object being painted, the eyes are particularly vulnerable to injury attributable to paint invasion or the like.

It is also well known in the art that paint cans are routinely constructed with a concentric groove atop the can for snugly receiving a friction lid. The lid is, in tum, constructed with a combination of a lip and trough configured to be received by corresponding paint can grooves that assure the securable closure of the paint can. While engaging in normal painting activities, a painter unavoidably causes paint to fall into this groove or trough during the brush-dragging process, which strives to remove excess paint from the bristles. Inevitably, particularly while painting for protracted periods of time, this trough will become saturated with paint, thereby causing further incursion of excess paint to be deposited upon the sides of the paint can and then communicated to adjacent surfaces and objects.

It will be appreciated that these infirmities commonly associated with painting may be further complicated by the paint brush handle and the paint can handle. When a painter uses a paint brush fraught with excess paint thereon, the painter will frequently introduce paint onto the both the paint brush handle and the paint can handle. For instance, excess paint located in the rim groove and trough tends to overflow down the side of the paint can onto the paint can handle when the paint brush is disposed in its normal horizontal resting position. This, of course, provides another source for paint to be inadvertently deposited onto a painter's hands and clothing, and to generally cause a mess.

There have been several developments in the art to improve the painting operation involving the use of paint brushes and paint cans. These developments have generally sought to secure a paint brush to the paint can to avoid waste or spillage, or for the convenience of the painter. For example, in U.S. Pat. No. 2,184,460, Linder discloses a device for holding a paint brush horizontally atop a paint can. Configured to be attached to a ladder, the Linder device teaches a horizontal sleeve that is attached to the lip of a paint can for supporting a paint brush.

As another example, Sobel, in U.S. Pat. No. 4,721,225, teaches a paint brush valet which is positioned by being attached over the brim of a paint can for supporting a paint brush vertically for drainage purposes. Snyder teaches, in U.S. Pat. No. 3,275,129, a paint brush keeper for preserving a paint brush during periods of non-use, wherein a plurality of closely-spaced internal circumferential grooves are situated near the bottom of the paint can for providing ridges on the exterior thereof. A removable flexible wire bracket, which is fitted within the can so that it may be snapped into a selected groove, is suspended into the can through a transverse hole in a paintbrush handle so that its bristles may be immersed into paint and the like stored in the can.

Other improvements in the art have introduced various clamp means for securing a paintbrush to a paint brush can and the like. For example, in U.S. Pat. No. 1,994,335, Churan teaches a combined brush rest and wiper for being placed in an open paint can and which is serviceable for wiping excess paint from a paint brush and for holding the brush during idle periods. A single length of wire is bent in partially circular form with an upstanding inverted V-shaped bight formed near the free ends of the wire—downwardly curved and having looped terminals. The end portions of adjacent bights are configured to be straight to accommodate overhanging engagement with loops of an upwardly arched wiper strip. The ends of this spring-like wiper strip are downwardly and outwardly curled to present hook-like extremities. This strip is interfitted with a wire member and engaged under the channeled mouth rim of the paint can.

Braille, in U.S. Pat. No. 1,972,861 discloses a wiper apparatus comprising a spring member formed with an annular section and a raised straight section, with the annular section extending through more than half a circle and snapped into a groove on the paint can rim section. The straight section acts like a rod extending across the paint can's open mouth and is situated for a wiping engagement with a paint brush wherein excess paint is wiped on the rod and is drained back into the paint can.

Ariss, in U.S. Pat. No. 2,683,553, discloses a bucket holder and wiper designed to wipe excess paint from a paint brush when used in conjunction with a step ladder. A brush wiper is mounted diametrically in the upper support of a paint can which is shaped in the form of a metallic rod. Suspension hooks are located at each end of this rod, which extend over the top of the paint can. When the hooks are engaged with the top of the paint can, its springs are tensioned to keep the wiper in place.

In U.S. Pat. No. 2,353,555, Gore teaches a paint brush scraper mounted in and carried by a paint bucket to permit a painter to scrape off excess paint picked up during dipping operation just prior to the painter applying the wet brush to a surface. Constructed from a single piece of wire, this scraper is configured in a U-shape and rigidly held in place within the paint bucket. It is provided with two uprights at each terminating in straight extension which communicate with an ordinary electric contact clip for holding the scraper in place on the paint bucket's rim.

Myers discloses a transversal brush wiper that includes double-loop members that clip onto a flange built into the paint can, in U.S. Pat. No. 2,355,549. These loops provide doubly bent, U-shaped end portions that are disposed to enable one branch of the loop to be inserted into a channel while the other branch engages the exterior surface of the flange. This flange is gripped firmly between the legs of the double loop. Prince teaches, in U.S. Pat. No. 2,109,803, a paint can adapted to have a pair of chordally disposed points offset to permit insertion of wiper ends. The friction closure has a wiper connected to the friction wall across the opening and below the top of the paint can, for allowing application and removal thereof. The wiper is secured to the paint can after it has been seamed to the paint can body so as not to interfere with the application or removal of the friction closure.

In U.S. Pat. No. 2,498,511, Smith discloses a paintbrush clamp designed to hold a plurality of paintbrushes in paint can of various sizes. The Smith clamp is designed to fit over the top edge of a paint can so that a paintbrush may be held vertically therewithin. Similarly, Embree teaches, in U.S. Pat. No. 2,489,875, a support consisting of a retractable clamp that holds a paintbrush vertically in a paint can.

In U.S. Pat. No. 2,315,269, Mbrgillo discloses a paintbrush clamp holder that attaches to the lip of a paint can. Using a spring-operated clip-arm, this apparatus enables the multi-positioning of a paintbrush within the paint can by pivoting the arm. Similarly, Hannan, in U.S. Pat. No. 2,184,667, teaches a spring-loaded device that is positioned over a paint can lip and holds a paintbrush vertically in the paint can. Simons, in U.S. Pat. No. 2,039,497, discloses a spring-loaded apparatus that attaches to the lip of a paint can and is designed to vertically suspend a plurality of paintbrushes.

Notwithstanding these developments in the art, there appears to be no apparatus which provides a simple but fail-safe structure that may be expeditiously put in place on variously sized paint cans for draining excess paint from a diversity of paint brushes to avoid waste and spillage, and that also provides a means for supporting a paint brush atop the paint can during rest periods and the like. Thus, it would be advantageous to utilize an apparatus which provides an expeditious procedure for reducing paint waste and minimizes the mess commonly associated with painting. It would be further advantageous if there were a such an apparatus which could: be conveniently retrofitted to variously sized paint cans when a painting operation commences—regardless of the size of the paint brush selected by the painter to accomplish the painting task.

Accordingly, these limitations and disadvantages of the prior art are overcome with the present invention, wherein a paint can support apparatus is provided that is particularly useful for enabling a practitioner to use a paintbrush after excess paint has been drawn from the paintbrush bristles.

SUMMARY OF THE INVENTION

The present invention provides an apparatus for clearing excess paint from paint brush bristles and for draining this excess paint back into the paint can. The present invention teach a novel no-drip clip apparatus that comprises a circular member for securely clipping embodiments to a paint can rim, and a contiguous linear flusher member that is suspended across the paint can's mouth. The present invention contemplates that a painter or like practitioner will use a suitable embodiment for reducing dripping of excess paint from the paint brush bristles onto the paint brush handle, the paint can rim, and, ultimately, onto nearby surfaces and objects during painting operations.

It is an object of the present invention to provide an apparatus for conveniently clearing excess paint from paint brush bristles.

It is another object of the present invention to provide an apparatus for clearing excess paint from paint brush bristles while simultaneously reducing incursion of paint onto the paint brush handle and into the annular groove disposed on the rim of a paint can.

It is still another object of the present invention to provide an apparatus for clearing excess paint from paint brush bristles thereby preventing causing a mess during painting operations.

It is yet another object of the present invention to provide an apparatus for horizontally supporting a paint brush atop a paint can during idle periods.

It is a specific object of the present invention to provide an apparatus with clip members that may be conveniently secured within the trough disposed upon a paint can rim.

It is another specific object of the present invention to provide an apparatus with a substantially circular member that may be conveniently inserted within the trough disposed upon a paint can rim.

It is yet another specific object of the present invention to provide an apparatus with handle members that may be conveniently grasped by a painter to insert the apparatus within the trough disposed upon a paint can rim or to remove the apparatus therefrom.

These and other objects and features of the present invention will become apparent from the following detailed description, wherein reference is made to the figures in the accompanying drawings.

IN THE DRAWINGS

DETAILED DESCRIPTION

Figure 1:
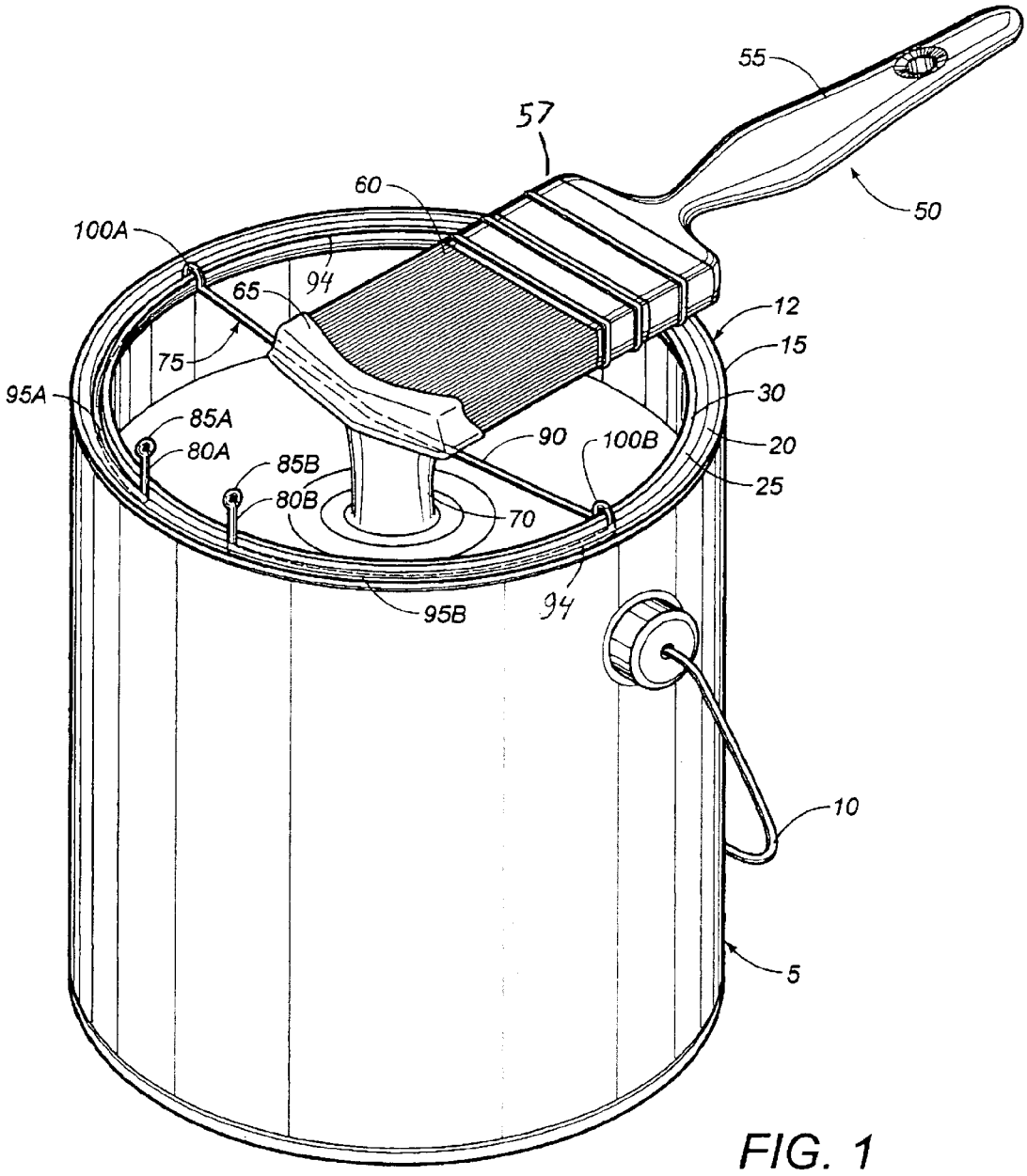
FIG. 1 depicts a frontal perspective view of a preferred embodiment of the present invention.
Figure 2B:
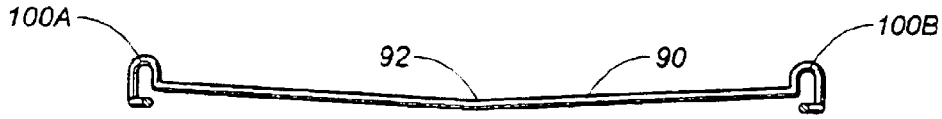
FIG. 2B depicts a front view of a portion of the embodiment depicted in FIG. 2A.
Figure 2A:
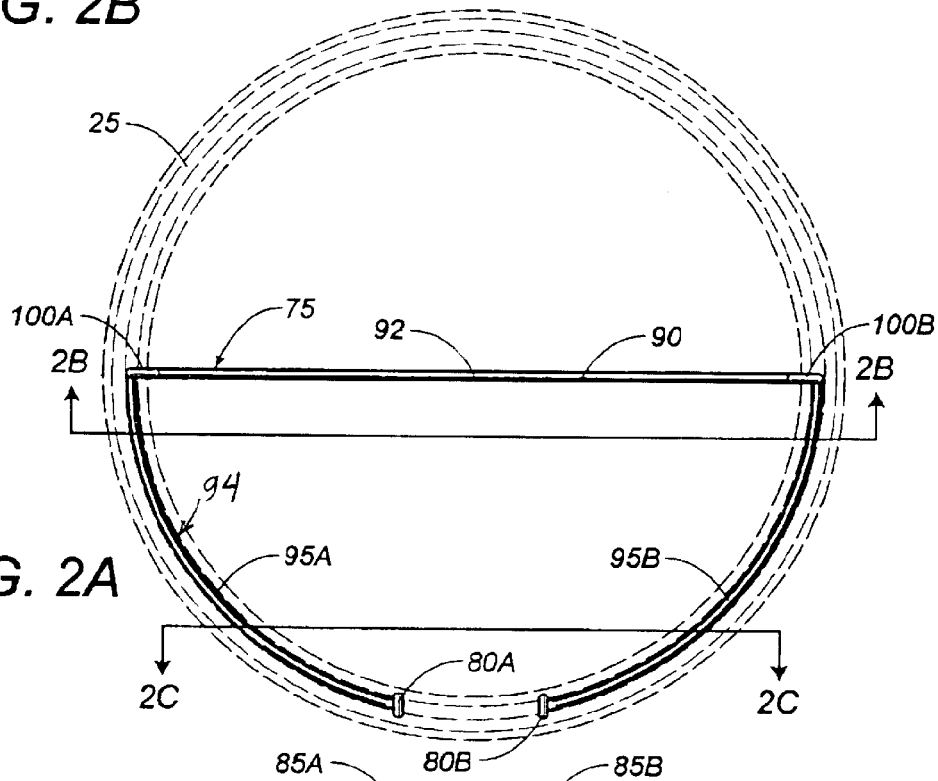
FIG. 2A depicts a plan view of the embodiment of the present invention depicted in FIG. 1.
Figure 2C:
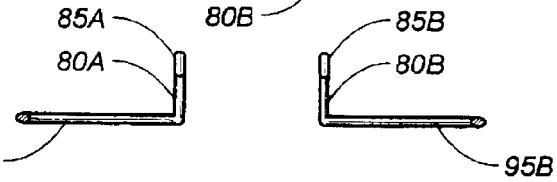
FIG. 2C depicts a rear view of another portion of the embodiment depicted in FIG. 2A.
Figure 2D:
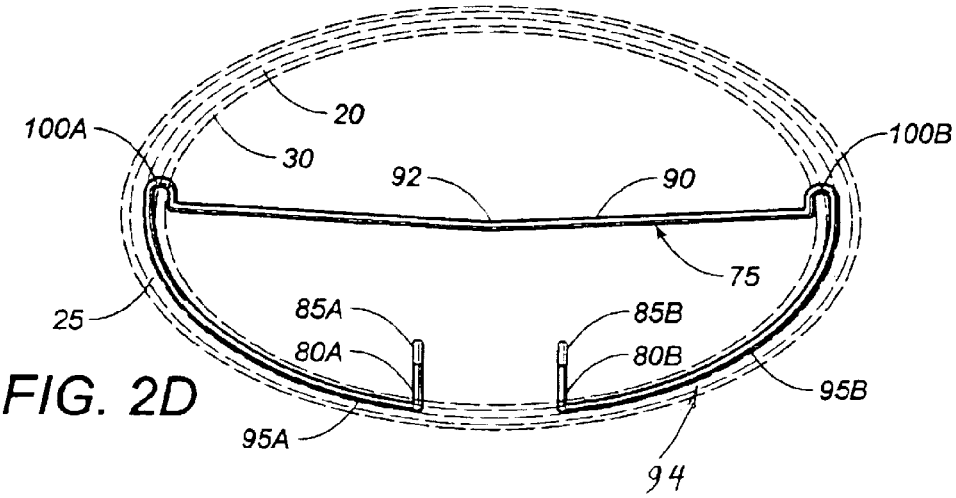
FIG. 2D depicts a front view of the embodiment depicted in FIG. 2A.

Referring to FIG. 1, there is shown preferred embodiment of the present invention 75 disposed atop uncovered paint can 5. Conventional paint can 5 is shown with handle 10 and heel member 57 of conventional paint brush 50 seated upon paint can rim member 12 with its plurality of bristles 60 seated upon transversal flusher member 90 of no-drip clip apparatus 75. Paint brush handle 55 is shown protruding from paint can 5. According to the teachings of the present invention, no-drip clip apparatus 75 is configured to facilitate the orderly and expeditious removal of excess paint 70 from normal paint load 65 adhering to plurality of brush bristles 60, wherein excess paint 70 is caused to neatly drip into, and resume being an integral part of, the reservoir of paint contained in paint can 5. As will readily be appreciated by those skilled in the art, such excess paint typically causes a wasteful mess by dripping onto paint can rim member 12 into trough member 20, and then draining onto the external walls of the paint can— and ultimately, probably dripping onto the proximal support surfaces disposed beneath the paint can.

Now referring collectively to FIGS. 1, 2A–2D, and 3, there is shown preferred embodiment 75 comprising linear flusher member 90 situated as a transversal suspended across the midway point of paint can 5. Paint can rim member 12 comprises trough member 20 disposed within inside wall member 30 and outside wall member 20. Congruent loop pair 100A and B disposed at opposite ends of flusher member 90 are securely engaged with each side of inside trough wall member 30 disposed atop the interior wall of paint can rim member 12, after first passing over lip member 25.

Specifically referring to FIGS. 2A–2D, the preferred positioning and structure of preferred embodiment 75 relative to conventional paint can 5 is shown. Linear flusher member 90 is configured with bowed midpoint 92 and pair of loop members 100A and B, with each loop member disposed at an opposite end thereof. Flusher member 90 is preferably configured to be at the same height as substantially circular member 94. Circular member 94 comprises pair of wing wire members 95A and B with linear transversal member 90 disposed at one end and pair of handle members, 80A and B, respectively, disposed at the other opposite end thereof. As shown in FIGS. 1–2, handle member pair 80A and B are disposed uprightly of circular member 94 and include loop member pair 85A and B, respectively, which are designed for a painter to conveniently grip for easily inserting pair of wing wire members 95A and B, respectively, into trough member 20 as will be hereinafter explained. Thus, circular member 94 is closed on one end by transversal flusher member 90 and open on the other end terminated in each branch thereof with upright handle member pair 80A and B.

As will be appreciated by those skilled in the art, flusher member 90 is preferably configured with a bow-like'structure or "V" configuration at midpoint 92 in order to promote the re-deposit of excess paint 70 back into the reservoir of paint contained in paint can 5, wherein this excess paint has been dislodged by a painter scraping plurality of paint brush bristles 60 across flusher member 90. This dislodged excess paint is caused to seek the lowest point of the "V" structure whereupon such excess paint drips into paint can 5 therebelow. It will, of course, be understood that, in order to remove a no-drip clip embodiment 75, may also used by a painter or the like first grips handle member pair 80A and B, and then sustains this grip to lift the no-drip clip apparatus from its snug seating within trough member 20. Once so removed, no-drip clip apparatus 75 may be conveniently wiped with a rag or the like so that it may be clean and ready for its next application. It should be evident to those conversant with the art that is preferable for the diameter of the wire member inherent in embodiments of the present invention to be sized to fit snugly within a paint can trough as herein described in: detail. It will also be appreciated that, if such wire included a knurled surface, then the diameter of such wire would be narrower than otherwise, in order to snugly fit into the corresponding paint can trough.

Figure 3:
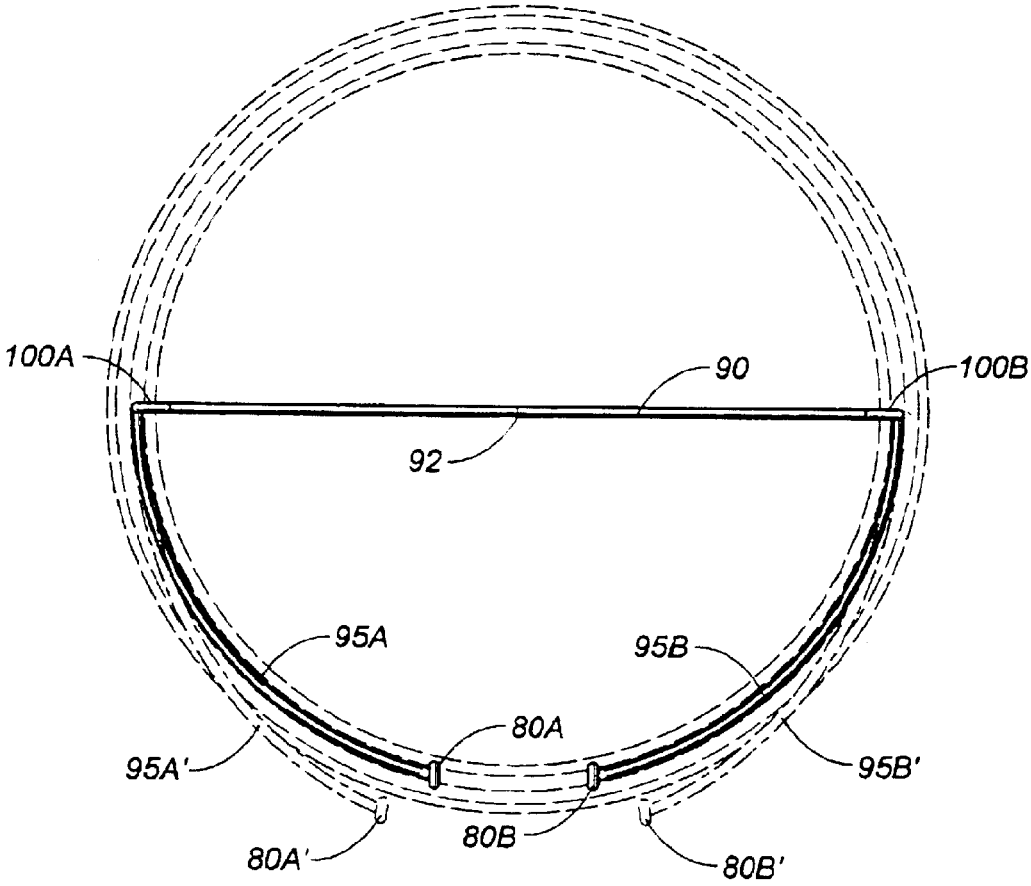
FIG. 3 depicts a plan view of the embodiment depicted in FIG. 2A, depicting the relationship between the curvature of embodiments of the present invention and the curvature of the paint can trough.

Referring now to FIG. 3, there is shown how the rigidity and flexibility of preferred embodiment 75 may be exploited to securably insert pair of wing wire members 95A and B into trough member 20. Prior to the insertion of wing wire pair 95A and B into trough member 20, wherein the wing wire members have the same angular configuration as this trough member, corresponding pre-inserted wing wire pair 95A' and B' are shown with dotted lines in FIG. 3. As contemplated under the teachings of the present invention, a painter or other operator manipulates pre-inserted wing wire pair 95A' and B' applying moderate hand-compression in order to force each wing wire of pre-inserted wing wire pair 95A' and B' to conform to the arcuate configuration—substantially circular—of trough member 20. As will be understood by those skilled in the art, once this hand-compression procedure has been effectuated, pre-inserted wing wire pair 95A' and B' have been snugly inserted into trough member 20 thereby being depicted as wing wire pair 95A and B.

It will be appreciated that the wire material used to structure embodiments of the present invention should preferably afford firm but spring-like characteristics to accomplish the purposes recited he rein. For example, such spring-like behavior of the wing wire pair of the present invention imparts sufficient pressure on the outer annular wall of the paint can rim trough member to sustain retention of these wing wire members therein. It is within the teachings of the present invention that maximum stability of this wing wire seating may be achieved by roughening via knurling or the like portions of the outer surface of the wing wire members; this roughening phenomenon assures secure emplacement of the wing wire pair within the trough member of the paint can rim by minimizing the chance that any slippage will occur.

It will be understood that trough member 20 is disposed in a conventional concentric relationship relative to the interior and exterior vertical walls of paint can 5. As will be described in detail, flusher member 90 is suspended across the paint can opening in a manner that promotes the removal of excess paint from plurality of paint brush bristles 60 and the consequent deposit of such excess paint 70 back into paint can 5. Thus, when a practitioner draws a plurality of paint-laden paint brush bristles across brush scraper member 90, excess paint 70 is caused to travel along this bowed rod-like structure to its central portion 92 primarily due to the effects of surface tension and gravity, whereby this excess paint drips into paint can 5. It will be thus be appreciated that the apparatus and concomitant methodology contemplated by the present invention prevents common waste of paint and associated inadvertent drippage into the paint can trough, onto the exterior sides of the paint can, and, ultimately, onto nearby surfaces and objects. It will be evident to those skilled in the art that only extreme carelessness by the painter or like practitioner will effectuate undesired paint drippage from a paint can constructed according to the present invention.

It will be understood that an important aspect of the present invention is that no-drip clip embodiments be sized so that its circular portion is configured to be substantially congruent with the circumferential trough of the paint can so that the no-drip clip's circular member may be properly seated and secured in such trough. As will be clear to those conversant in the art, embodiments of the present invention are inherently configured so that both the circular portion— with its pair of winged wire members— and the corresponding linear flusher portion are properly dimensioned to be securely inserted into a paint can's rim member. It should also be apparent that the painter should be select a no-drip clip sized to accommodate differently dimensioned paint cans, wherein the wing wire pair of the circular member is configured to be substantially congruent with the paint can rim's trough member.

It will also be appreciated that the flusher member taught by the present invention may be offset to avoid inhibiting mixing of the paint and entry and removal of the paint brush by a painter. This offset configuration is further advantageous because it enables the paint can to be carried by its handle to perform touch-up painting and the like without any interference.

Figure 4:
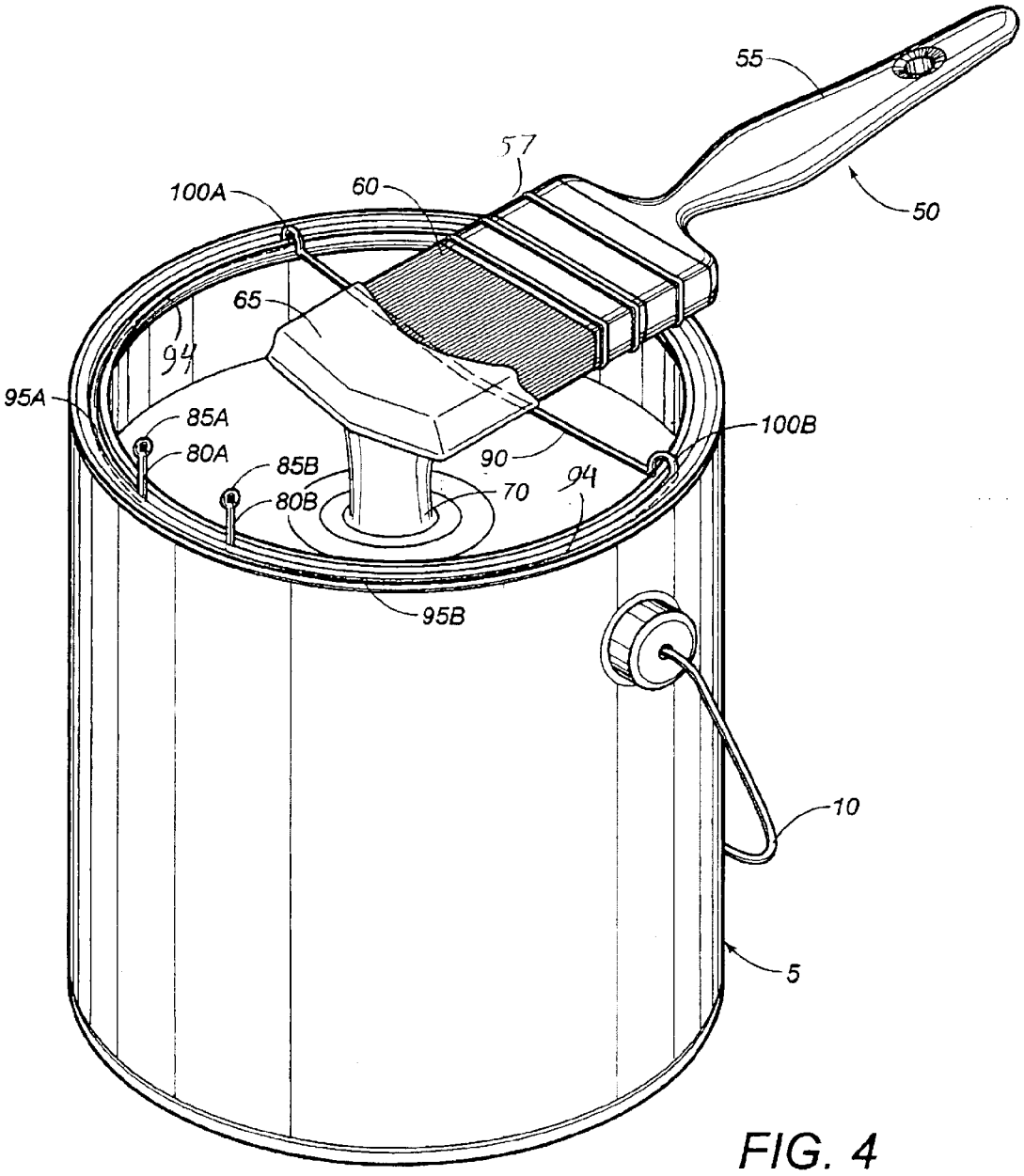
FIG. 4 depicts a frontal perspective view of an alternate embodiment of the present invention.
Figure 5B:
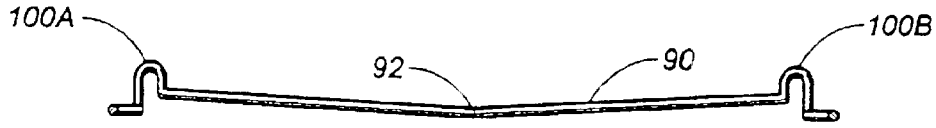
FIG. 5B depicts a front view of a portion of the embodiment depicted in FIG. 5A.
Figure 5A:
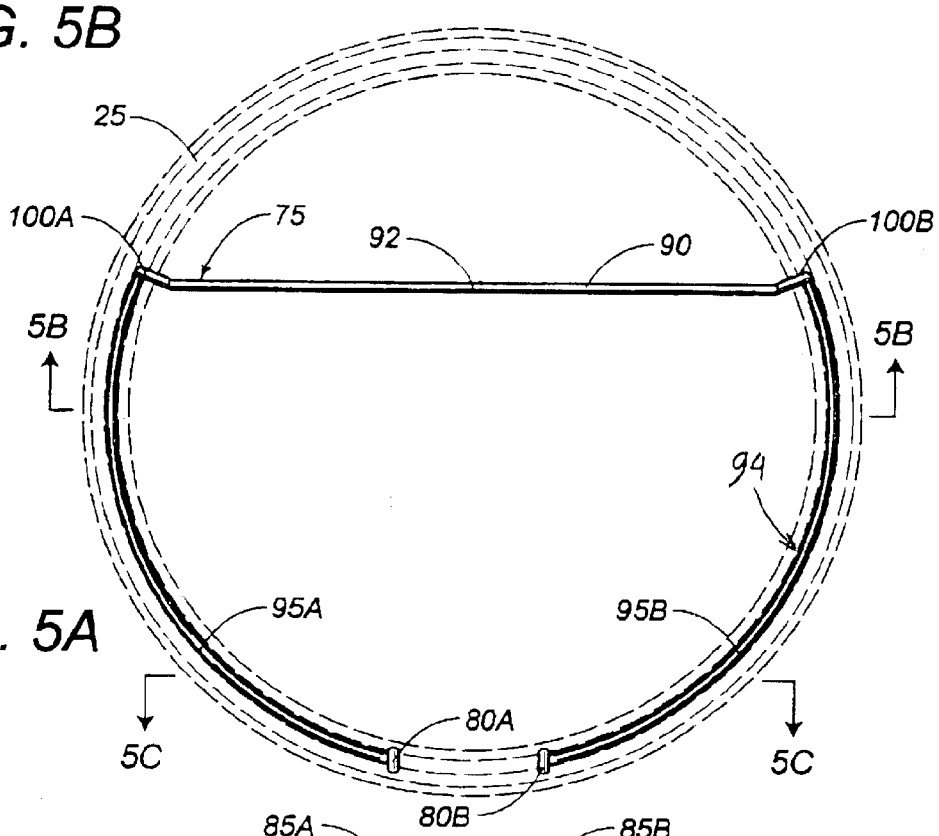
FIG. 5A depicts a plan view of the embodiment of the present invention depicted in FIG. 4.
Figure 5C:
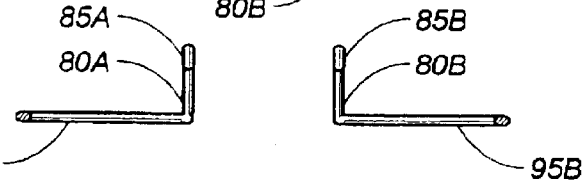
FIG. 5C depicts a rear view of another portion of the embodiment depicted in FIG. 5A.
Figure 5D:
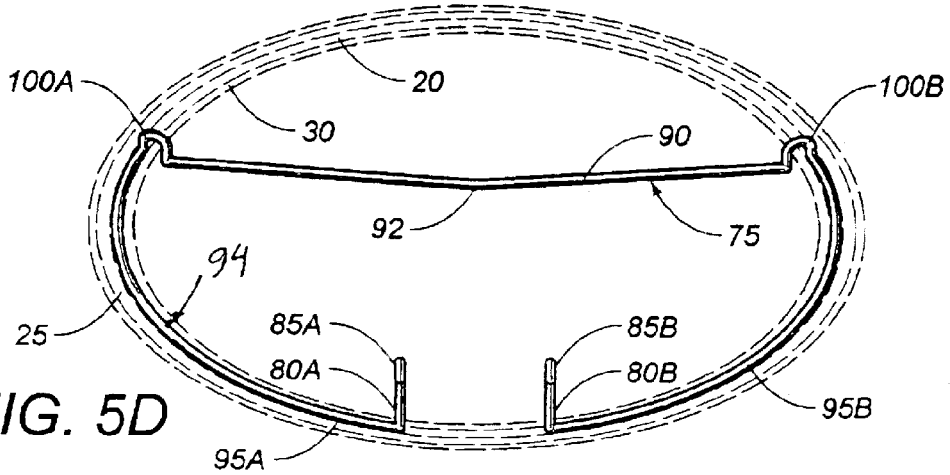
FIG. 5D depicts a front view of the embodiment depicted in FIG. 5A.

Thus, referring to FIG. 4, there is shown an alternative embodiment of the present invention 75 disposed atop uncovered paint can 5. Conventional paint can 5 is shown with handle 10 and heel member 57 of conventional paint brush 50 seated upon paint can rim member 12 with its plurality of bristles 60 seated upon transversal flusher member 90 of no-drip clip apparatus 75. Paint brush handle 55 is shown protruding from paint can 5. According to the teachings of the present invention, no-drip clip apparatus 75 is configured to facilitate the orderly and expeditious removal of excess paint 70 from normal paint load 65 adhering to plurality of brush bristles 60, wherein excess paint 70 is caused to neatly drip into, and resume being an integral part of, the reservoir of paint contained in paint can 5. Unlike in the preferred embodiment of the present invention depicted in similar FIG. 1, linear flusher member 90 is adapted to be offset from the center of mouth of the paint can. That is, while the flusher member shown in FIG. 1 is depicted as emplaced along the paint can diameter, the corresponding flusher member depicted in FIG. 4 is clearly offset from the center of the paint can opening. Otherwise, as will become evident from a description of this alternative structure as further depicted in FIGS. 2A–2D, and 3, the components of these embodiments are the same.

It will be understood, however, that offset embodiments are more compatible with wider paint brushes because their greater width—manifest in the heel portion and the plurality of brush bristles—fit more conveniently into a paint can with a wider opening. Obviously, if the flusher member of the present invention is situated in approximately the paint can's midpoint, then a wide paint brush's access to the interior of the paint can is inhibited. It will be appreciated that embodiments of the present invention will be configured to accommodate all situations regardless of paint can dimensions and paint brush size. It should be clear to practitioners in the art that selection of appropriately sized no-drip clip embodiments are dictated by such paint can dimensions and paint brush size, wherein not only convenience and efficiency may be achieved, but also stability may be assured once they are inserted into paint can lids.

Accordingly, referring collectively to FIGS. 4, 5A–5D, and 6, there is shown preferred embodiment 75 comprising flusher member 90 situated as a transversal suspended across a point offset from the midway point of paint can 5. Specifically referring to FIGS. 5A–5D, the preferred positioning and structure of preferred embodiment 75 relative to conventional paint can 5 is shown. Linear flusher member 90 is configured with bowed midpoint 92 and pair of loop members 100A and B, with each loop member disposed at an opposite end thereof. Flusher member 90 is preferably configured to be at the same height as substantially circular member 94. Circular member 94 comprises pair of wing wire members 95A and B with linear transversal member 90 disposed at one end and pair of handle members, 80A and B, respectively, disposed at the other opposite end thereof. As shown in FIGS. 4–5 (A–D), handle member pair 80A and B are disposed uprightly of circular member 94 and include loop members 85A and B which are designed for a painter to conveniently insert pair of wind wire members 95A and B into trough member 20.

Figure 6:
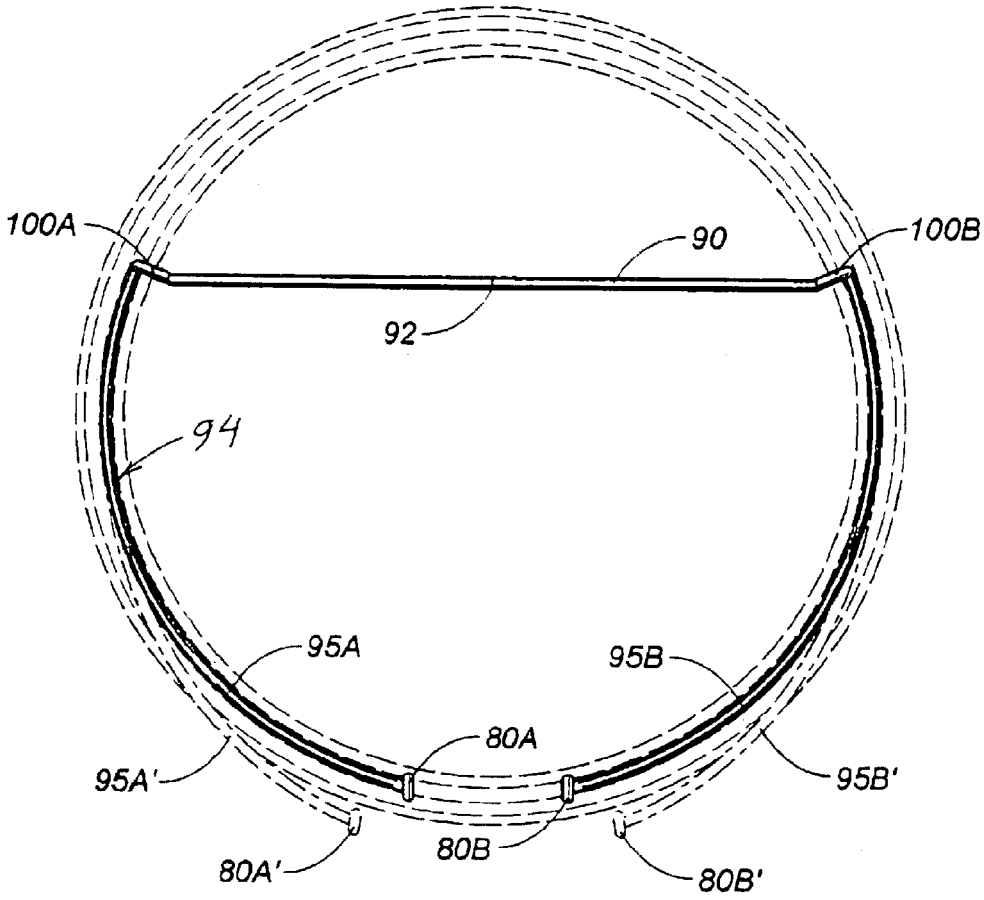
FIG. 6 depicts a plan view of the embodiment depicted in FIG. 5A, depicting the relationship between the curvature of embodiments of the present invention and the curvature of the paint can trough.

Referring now to FIG. 6, there is shown how the rigidity and flexibility of preferred embodiment 75 may be exploited to securably insert pair of wing wire members 95A and B into trough member 20. Prior to the insertion of wing wire pair 95A and B into trough member 20, wherein the wing wire members have the same angular configuration as this trough member, corresponding pre-inserted wing wire pair 95A' and B' are shown with dotted lines in FIG. 6. As contemplated under the teachings of the present invention, a painter or other operator manipulates pre-inserted wing wire pair 95A' and B' applying moderate hand-compression in order to force each wing wire of pre-inserted wing wire pair 95A' and B' to conform to the arcuate configuration—substantially circular—of trough member 20. Once this hand-compression procedure has been effectuated, pre-inserted wing wire pair 95A' and B' have been snugly inserted into trough member 20 thereby being depicted as wing wire pair 95A and B.

It should be evident to those skilled in the art that, a painter using an embodiment of the present invention during painting, may rest a paint brush upon the contemplated flusher member for convenience. Thus, during periods of interruption of painting or during rest periods and the like, under the present invention, a painter may simply rest a paint brush upon the flusher member thereby providing a means for emplacing a paint brush without causing excess paint adhering to its plurality of bristles from dripping onto nearby furniture and the like, or upon the floor. As will be appreciated by those skilled in the art, the flusher member of the present invention also conserves paint by avoiding wasteful dripping into a trough disposed on a paint can rim or onto nearby furniture and the like or onto the floor. Furthermore, particularly helpful to casual painters or workers casually engaging in home-repair activities, embodiments of the present invention tend to minimize the recurrence of paint brush handles becoming unduly soiled with excess or dripping paint, thereby, minimizing the likelihood that such casual painters will inadvertently soil clothing and other valuables with paint.

It has been observed that no-drop clip embodiments with flusher members offset from the center of the paint can tend to avoid interfering with the normal functioning of the paint can handle. It will, of course, be appreciated that the present invention functions on paint cans of all sizes, with or without handles affixed thereon.

It is an important feature and advantage of the present invention that practitioners in the art may engage in painting activity in a mess-free and efficient manner. It should be evident to those skilled in the art that the present invention teaches how to supply paint to paint brush bristles and to the work in an effective and clean manner. Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. For a cylindrical paint can having interior walls and an open end, and having a concentric rim member including a lip member with a contiguous annular trough member, a paint can clip-on apparatus for enabling a painter to wipe excess paint from a plurality of bristles of a paint brush while said painter is painting and for supporting said paint brush when said painter is idle, said paint can clip-on apparatus comprising:

a continuous rigid and flexible wire configured into a substantially circular member adapted to be springingly inserted into said trough member;

said circular member having a pair of congruent oppositely disposed wing wire members each configured with an arcuate member that requires said painter to apply hand-pressure for said circular member to be snugly fit into said trough member;

each of said wing wire members having a pair of congruent upright loop handle members disposed at an open end of said circular member, for said painter to conveniently inwardly compress said pair of wing wire members for snugly being inserted into said trough member and for conveniently applying lifting pressure thereupon to withdraw said pair of wing wire members from said trough member;

a linear and downwardly bowed flusher member disposed contiguously with said circular member and disposed oppositely of said pair of upright loop handle members, for enabling said painter to draw said plurality of bristles of said paint brush across said flusher member for wiping excess paint from said plurality of bristles and to rest said paint brush thereon during idle painting; and said flusher member configured with a pair of congruent loop members, with each said loop member adapted to be secured to said trough member by said painter passing each said loop member over said lip member and engaging said trough member.

2. The paint can clip-on apparatus recited in claim 1, wherein said pair of wing wire members are inserted into said trough member so that said flusher member is disposed to cross said open end of said paint can at the midway point thereof.

3. The paint can clip-on apparatus recited in claim 1, wherein said pair of wing wire members are inserted into said trough member so that said flusher member is disposed to cross said open end of said paint can at a position offset from said midway point thereof.

* * * * *